US006268831B1

(12) United States Patent
Sanford

(10) Patent No.: US 6,268,831 B1
(45) Date of Patent: Jul. 31, 2001

(54) INVERTED-F ANTENNAS WITH MULTIPLE PLANAR RADIATING ELEMENTS AND WIRELESS COMMUNICATORS INCORPORATING SAME

(75) Inventor: Gary George Sanford, Apex, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/542,616

(22) Filed: Apr. 4, 2000

(51) Int. Cl.[7] ..... H01Q 1/24
(52) U.S. Cl. ..... 343/702; 343/700 MS
(58) Field of Search ..... 343/700 MS, 702, 343/873, 850, 829, 846; H01Q 1/24, 9/04

(56) References Cited

U.S. PATENT DOCUMENTS

| | | | | |
|---|---|---|---|---|
| 5,365,246 | * | 11/1994 | Rasinger et al. | 343/702 |
| 5,764,190 | | 6/1998 | Murch et al. | 343/702 |
| 5,926,139 | * | 7/1999 | Korisch | 343/702 |
| 5,986,606 | * | 11/1999 | Kossiavas et al. | 343/700 MS |
| 6,100,850 | * | 8/2000 | Utsumi | 343/702 |
| 6,166,694 | * | 12/2000 | Ying | 343/702 |
| 6,184,836 | * | 2/2001 | Ali | 343/702 |

FOREIGN PATENT DOCUMENTS

| | | |
|---|---|---|
| 0630069 | 12/1994 | (EP) . |
| 0892459 | 1/1999 | (EP) . |
| WO90/13152 | 11/1990 | (WO) . |

* cited by examiner

*Primary Examiner*—Tho Phan
(74) *Attorney, Agent, or Firm*—Myers Bigel Sibley & Sajovec

(57) ABSTRACT

Inverted-F antennas that resonate within first and second frequency bands for use within communications devices, such as radiotelephones, are provided. A first planar conductive element has an elongated, rectangular configuration that extends along a first direction. The first planar conductive element has opposite first and second sides and an elongated edge. One or more additional planar conductive elements are electrically connected to the elongated edge of the first planar conductive element. Each additional planar conductive element has an elongated, rectangular configuration that extends along a second direction that is substantially parallel with the first direction. Each additional planar conductive element is maintained in adjacent, co-planar, spaced-apart relationship with the first planar conductive element.

20 Claims, 4 Drawing Sheets

INVERTED-F ANTENNAS WITH MULTIPLE PLANAR RADIATING ELEMENTS AND WIRELESS COMMUNICATORS INCORPORATING SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones.

In addition, it is becoming desirable for radiotelephones to be able to operate within multiple frequency bands in order to utilize more than one communications system. For example, GSM (Global System for Mobile communication) is a digital mobile telephone system that typically operates at a low frequency band, such as between 880 MHz and 960 MHz. DCS (Digital Communications System) is a digital mobile telephone system that typically operates at high frequency bands, such as between 1710 MHz and 1880 MHz. The frequency bands allocated in North America are 824–894 MHz for Advanced Mobile Phone Service (AMPS) and 1850–1990 MHz for Personal Communication Services (PCS). Since there are two different frequency bands, radiotelephone service subscribers who travel over service areas employing different frequency bands may need two separate antennas unless a dual-frequency antenna is used.

Inverted-F antennas are designed to fit within the confines of radiotelephones, particularly radiotelephones undergoing miniaturization. As is well known to those having skill in the art, inverted-F antennas typically include a linear (i.e., straight) conductive element that is maintained in spaced apart relationship with a ground plane. Examples of inverted-F antennas are described in U.S. Pat. Nos. 5,684,492 and 5,434,579 which are incorporated herein by reference in their entirety.

Conventional inverted-F antennas typically resonate within a narrow frequency band. In addition, conventional inverted-F antennas may be large in size compared with available space within many contemporary radiotelephones. Lumped elements can be used to match a smaller antenna to an RF circuit. Unfortunately, lumped elements may introduce additional losses in the overall transmitted/received signal, may take up circuit board space, and may add to manufacturing costs.

High dielectric substrates are commonly used to decrease the physical size of an antenna. Unfortunately, the incorporation of higher dielectrics can reduce antenna bandwidth and may introduce additional signal losses. As such, a need exists for small, internal radiotelephone antennas that can operate within multiple frequency bands, including low frequency bands.

SUMMARY OF THE INVENTION

In view of the above discussion, the present invention can provide various configurations of compact inverted-F antennas for use within communications devices, such as radiotelephones. According to one embodiment, an inverted-F antenna that resonates within first and second frequency bands includes first, second and third planar conductive elements. The first planar conductive element has an elongated, rectangular configuration that extends along a first direction. The first planar conductive element has opposite first and second sides and an elongated edge.

The second planar conductive element is electrically connected to the elongated edge of the first planar conductive element. The second planar conductive element has an elongated, rectangular configuration that extends along a second direction that is substantially parallel with the first direction. The second planar conductive element is maintained in adjacent, co-planar, spaced-apart relationship with the first planar conductive element.

The third planar conductive element is electrically connected to the elongated edge of the first planar conductive element and has an elongated, rectangular configuration that extends along the second direction. The third planar conductive element is maintained in adjacent, co-planar, spaced-apart relationship with the first and second planar conductive elements. The first planar conductive element has a width that is less than a width of the second planar conductive element and less than a width of the third planar conductive element.

A signal feed electrically extends outwardly from the first conductive element and electrically connects the first conductive element to a transceiver within the communications device. A ground contact is electrically connected to the first conductive element adjacent the signal feed and grounds the antenna to a ground plane within the communications device.

According to another embodiment of the present invention, an inverted-F antenna that resonates within first and second frequency bands includes first and second planar conductive elements maintained in adjacent, co-planar, spaced-apart relationship with each other. The first planar conductive element has an elongated, rectangular configuration that extends along a first direction. The first planar conductive element includes opposite first and second sides, and an elongated edge.

The second planar conductive element is electrically connected to the elongated edge of the first planar conductive element. The second planar conductive element has an elongated, rectangular configuration that extends along a second direction substantially parallel with the first direction. The second planar conductive element is maintained in adjacent, co-planar, spaced-apart relationship with the first planar conductive element. The length of the first planar conductive element is greater than the length of the second planar conductive element. The width of the first planar conductive element is less than the width of the second planar conductive element.

A signal feed electrically extends outwardly from the first conductive element and electrically connects the first conductive element to a transceiver within the communications device. A ground contact is electrically connected to the first conductive element adjacent the signal feed and grounds the antenna to a ground plane within the communications device.

Antennas according to the present invention may be particularly well suited for use within a variety of communications systems utilizing different frequency bands. Furthermore, because of their small size, antennas according to the present invention may be easily incorporated within small communications devices. In addition, antenna structures according to the present invention may not require additional impedance matching networks, which may save internal radiotelephone space and which may lead to manufacturing cost savings.

DETAILED DESCRIPTION OF THE INVENTION

Figure 1:
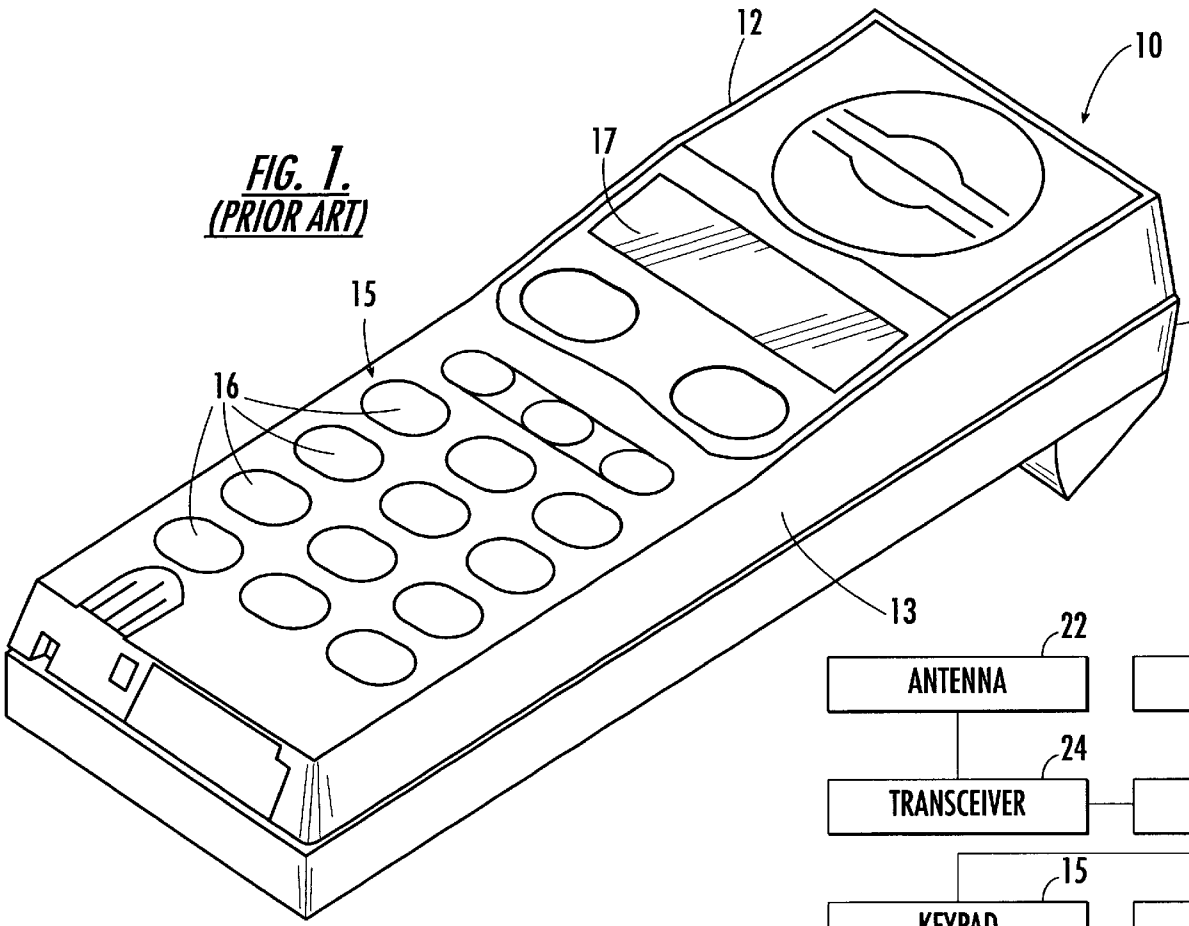
FIG. 1. (PRIOR ART)
FIG. 1 is a perspective view of an exemplary radiotelephone within which antennas according to the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings. It will be understood that when an element such as a layer, region or substrate is referred to as being "on" another element, it can be directly on the other element or intervening elements may also be present. In contrast, when an element is referred to as being "directly on" another elements there are no intervening elements present.

Referring now to FIG. 1, a radiotelephone 10, within which antennas according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

Figure 2:
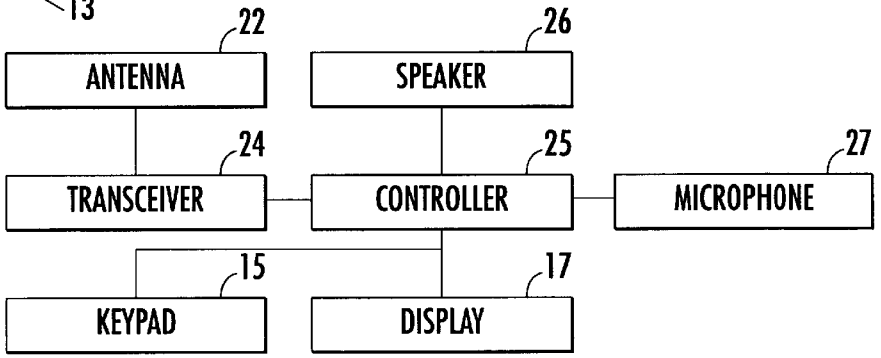
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to compensate for undesired antenna impedance components to provide a 50 Ohm (Ω) (or desired) impedance value at the feed point.

Figure 3A:
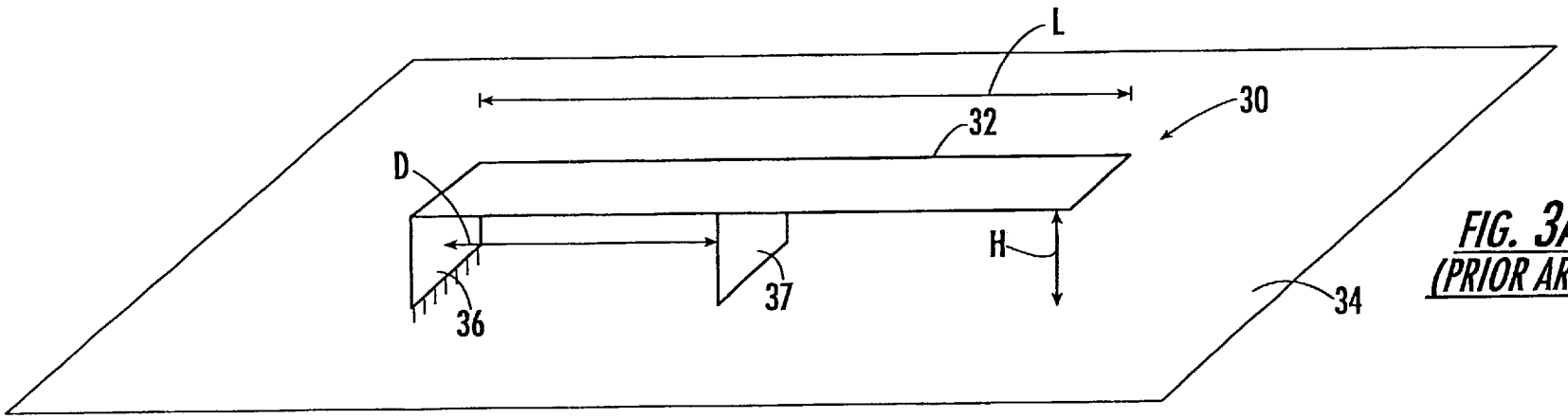
FIG. 3A. (PRIOR ART)
FIG. 3A is a perspective view of a conventional planar inverted-F antenna.
Figure 3B:
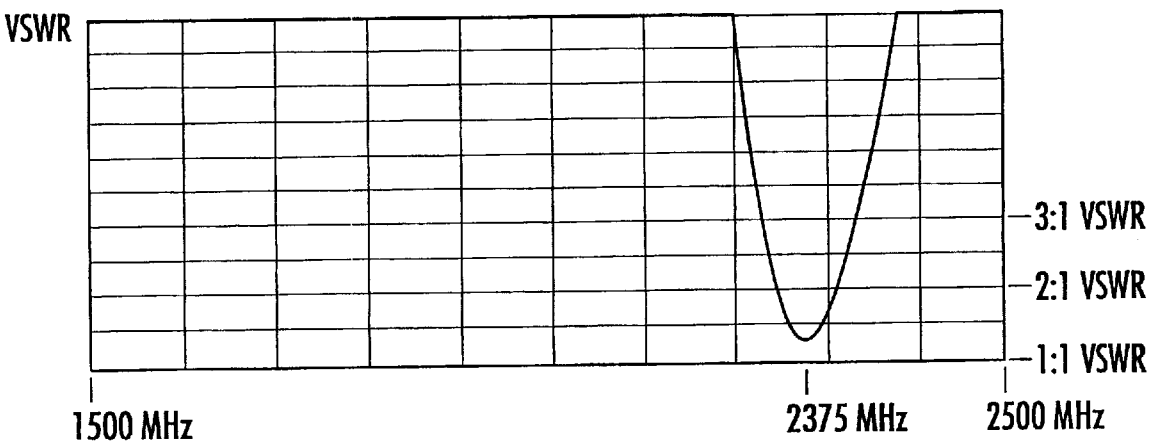
FIG. 3B. (PRIOR ART)
FIG. 3B is a graph of the VSWR performance of the antenna of FIG. 3A.

Referring now to FIG. 3A, a conventional inverted-F antenna is illustrated. The illustrated antenna 30 includes a linear conductive element 32 maintained in spaced apart relationship with a ground plane 34. Conventional inverted-F antennas, such as that illustrated in FIG. 3A, derive their name from a resemblance to the letter "F." The conductive element 32 is grounded to the ground plane 34 as indicated by 36. An RF connection 37 extends from RF circuitry underlying or overlying the ground plane 34 to the conductive element 32. FIG. 3B is a graph of the VSWR performance of a typical inverted-F antenna, such as the inverted-F antenna 30 of FIG. 3A.

Figure 4A:
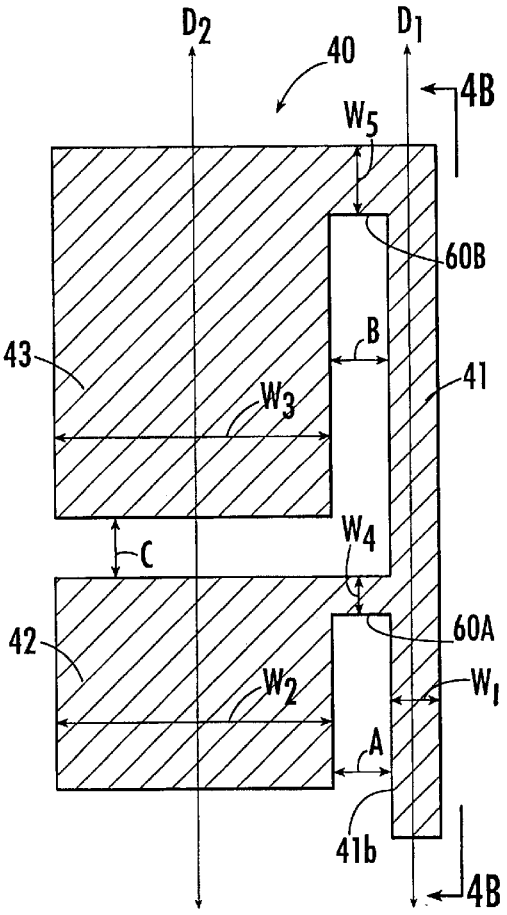
FIG. 4A is a top plan view of an inverted-F antenna having multiple radiating elements according to an embodiment of the present invention.
Figure 4C:
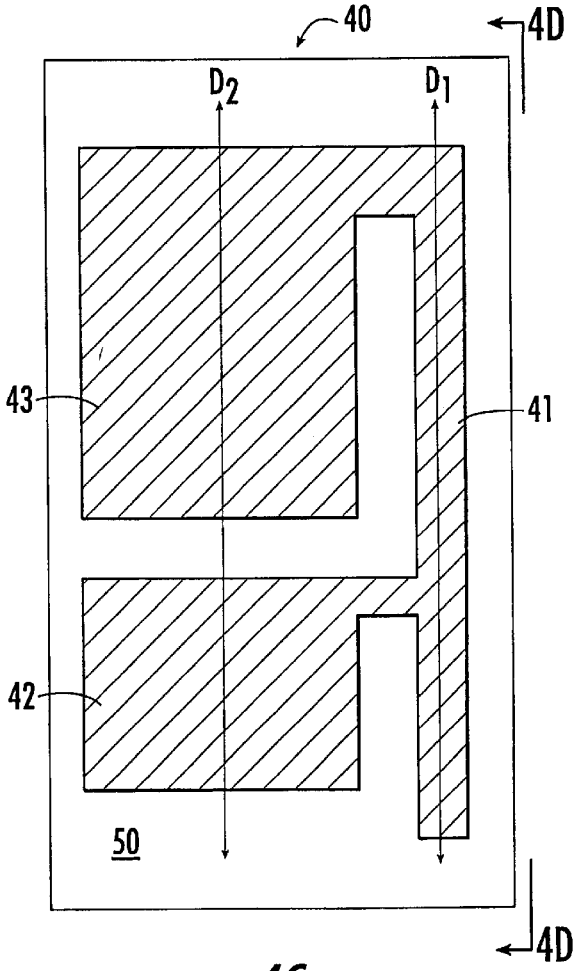
FIG. 4C is a top plan view of a dielectric substrate having an inverted-F antenna with multiple planar, conductive elements disposed thereon, according to another embodiment of the present invention.
Figure 4B:
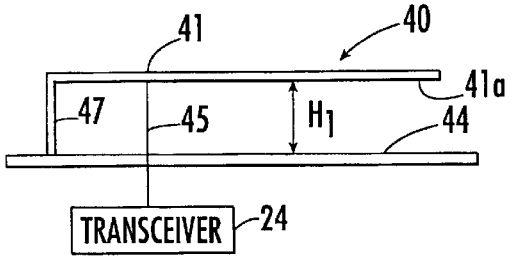
FIG. 4B is a side elevation view of the antenna of FIG. 4A taken along lines 4B—4B and illustrating the antenna in spaced-apart, adjacent relationship with a ground plane within a communications device.

Referring now to FIGS. 4A and 4B, a compact, dual band inverted-F antenna 40 for use within wireless communication devices such as radiotelephones is illustrated. As illustrated in FIG. 4A, the inverted-F antenna 40 includes first, second and third planar conductive elements 41, 42, 43 which are maintained, preferably, in co-planar relationship. As illustrated in FIG. 4B, when installed within a wireless communications device, such as a radiotelephone, the first, second and third planar conductive elements 41, 42, 43 are maintained in adjacent, spaced-apart relationship with a ground plane 44 (e.g., a printed circuit board or shield can overlying a printed circuit board). The first, second and third planar conductive elements 41, 42, 43 are maintained spaced-apart from the ground plane 44 by a distance $H_1$, which should be as large as possible, and typically between about 4 millimeters (mm) and about 12 mm. A signal feed 45 extends from a face 41*a* of the first planar conductive element 41 as illustrated and electrically connects the antenna 40 to an RF transceiver 24 within a wireless communications device. A ground contact 47 also extends from the face 41*a* of the first planar conductive element 41 adjacent the signal feed 45, as illustrated, and electrically grounds the antenna 40 (via the ground plane 44).

The illustrated first planar conductive element 41 has an elongated, rectangular configuration that extends along a first direction $D_1$. The illustrated second and third planar conductive elements 42, 43 also have elongated, rectangular configurations that extend along a second direction $D_2$, which is substantially parallel with the first direction $L_1$. The term "substantially parallel" is understood to mean that directions $D_1$ and $D_2$ are within plus or minus thirty degrees of parallelism therebetween. However, the first and second directions $D_1$, and $D_2$, need not be parallel.

In addition, it is understood that the first, second and third planar, conductive elements 41, 42, 43 can have various shapes and configurations. The first, second and third planar, conductive elements 41, 42, 43 are not limited to the illustrated rectangular configurations.

The second and third planar conductive elements 42, 43 are electrically connected to the first conductive element along an edge portion 41*b*, as illustrated. The first, second and third planar conductive elements 41, 42, 43 are preferably maintained in adjacent, co-planar, spaced-apart relationship, as illustrated. Preferably, the second planar conductive element 42 is spaced apart from the first planar conductive element 41 by a distance A of between about 1 mm and 2 mm. Preferably, the third planar conductive element 43 is spaced apart from the first planar conductive element 41 by a distance B of between about 1 mm and 2 mm. Preferably, the third planar conductive element 43 is spaced apart from the second planar conductive element 42 by a distance C of between about 1 mm and 2 mm.

The width of the first planar conductive element 41 is designated as $W_1$, and the widths of the second and third planar conductive elements 42, 43 are designated as $W_2$, $W_3$, respectively. Preferably, the second and third widths $W_2$, $W_3$ are greater than the first width $W_1$.

The portion 60*a* that connects the second conductive element 42 to the first conductive element 41 has a width designated as $W_4$. The portion 60*b* that connects the third conductive element 43 to the first conductive element 41 has a width designated as $W_5$. In some cases it may be advantageous to substantially increase $W_4$ with respect to $W_5$, and vice versa.

Figure 4D:
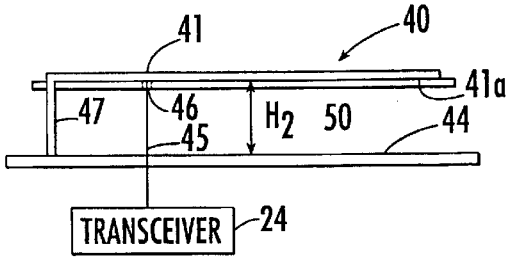
FIG. 4D is a side elevation view of the antenna of FIG. 4C taken along lines 4D—4D and illustrating the antenna in adjacent, spaced-apart relation with a ground plane within a communications device.

According to another embodiment, illustrated in FIGS. 4C and 4D, the compact, dual band inverted-F antenna 40 described above may be formed on a dielectric substrate 50, for example by etching a metal layer in the pattern of the first, second and third conductive elements 41, 42, 43 on the dielectric substrate 50. An exemplary material for use as a dielectric substrate 50 is FR4 or polyimide, which is well known to those having skill in the art of communications devices. However, various other dielectric materials also may be utilized. Preferably, the dielectric substrate 50 has a dielectric constant between about 2 and about 4. However, it is to be understood that dielectric substrates having different dielectric constants may be utilized without departing from the spirit and intent of the present invention.

As illustrated in FIG. 4D, when installed within a wireless communications device, such as a radiotelephone, the dielectric substrate 50 having the first, second and third conductive elements 41, 42, 43 disposed thereon is maintained in adjacent, spaced-apart relationship with a ground plane 44. A signal feed 45 extends from a face 41*a* of the first planar conductive element 41 as illustrated, through an aperture 46 in the dielectric substrate 50, and electrically connects the antenna 40 to an RF transceiver 24 within a wireless communications device.

A ground contact 47 also extends from the face 41*a* of the first planar conductive element 41 adjacent the signal feed 45, as illustrated, and electrically grounds the antenna 40 (via the ground plane 44). The distance $H_2$ between the dielectric substrate 50 and the ground plane 44 is preferably as large as possible, and is typically maintained at between about 4 mm and about 12 mm.

Figure 5:
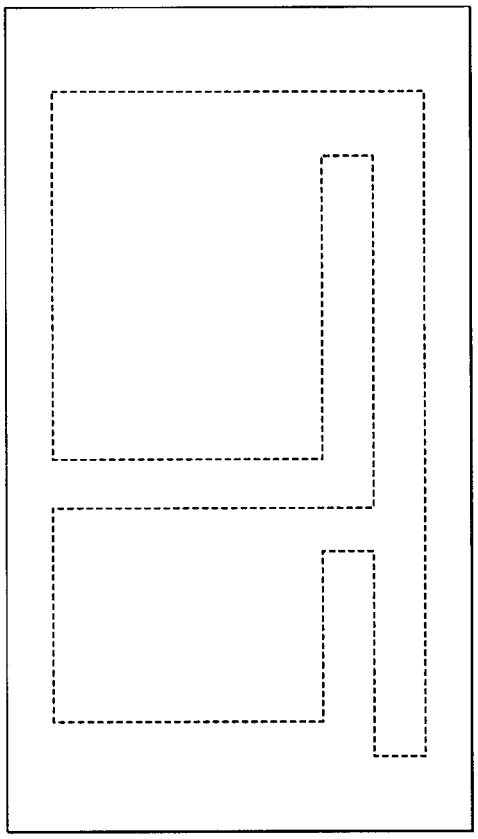
FIG. 5 is a top plan view of a dielectric substrate having an inverted-F antenna with multiple planar, conductive elements disposed therewithin, according to another embodiment of the present invention.

According to another embodiment of the present invention, the compact, dual band inverted-F antenna 40 described above may be disposed within a dielectric substrate 50 as illustrated in FIG. 5.

Figure 6:
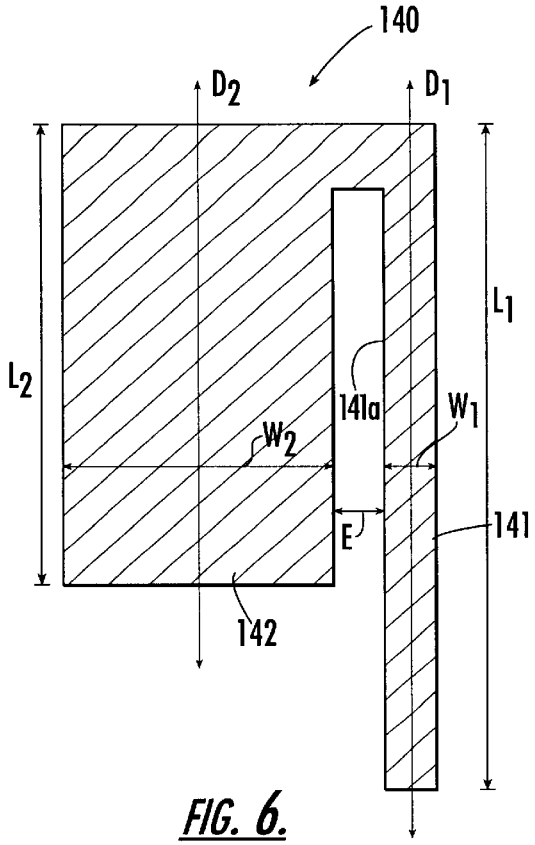
FIG. 6 is a top plan view of an inverted-F antenna having multiple planar, conductive elements according to another embodiment of the present invention.

According to another embodiment, illustrated in FIG. 6, a compact, dual band inverted-F antenna 140 includes a first planar conductive element 141. The first planar conductive element 141 has an elongated, rectangular configuration that extends along a first direction $D_1$. A second planar conductive element 142 is electrically connected to an edge 141*a* of the first planar conductive element 141, as illustrated, and is maintained in adjacent, co-planar, spaced-apart relationship with the first planar conductive element.

The second planar conductive element 142 has an elongated, rectangular configuration that extends along a second direction $D_2$ that is substantially parallel with the first direction $D_2$. The first planar conductive element 141 has a first width $W_1$, and a first length $L_1$, and the second planar conductive element 142 has a second width $W_2$ and a second length $L_2$. The width $W_1$, of the first planar conductive element 141 is preferably less than the width $W_2$ of the second planar conductive element 142. Preferably, the second planar conductive element 142 is spaced apart from the first planar conductive element 141 by a distance E of between about 1 mm and 2 mm.

A preferred conductive material out of which the various planar conductive elements (41, 42, 43, 141, 142) of FIGS. 4A–4D and FIGS. 5–6 may be formed is copper. For example, the various planar conductive elements may be formed from copper sheet.

Alternatively, the various planar conductive elements may be a copper layer formed on a substrate, as illustrated in FIGS. 4C and 4D. However, planar conductive elements according to the present invention may be formed from various conductive materials and are not limited to copper.

The thickness of the various planar conductive elements (41, 42, 43, 141, 142) of FIGS. 4A–4D and FIGS. 5–6 is typically between about 0.02 mm and about 0.40 mm. However, the various planar conductive elements (41, 42, 43, 141, 142) of FIGS. 4A–4D and FIGS. 5–6 may have various thicknesses.

Figure 7:
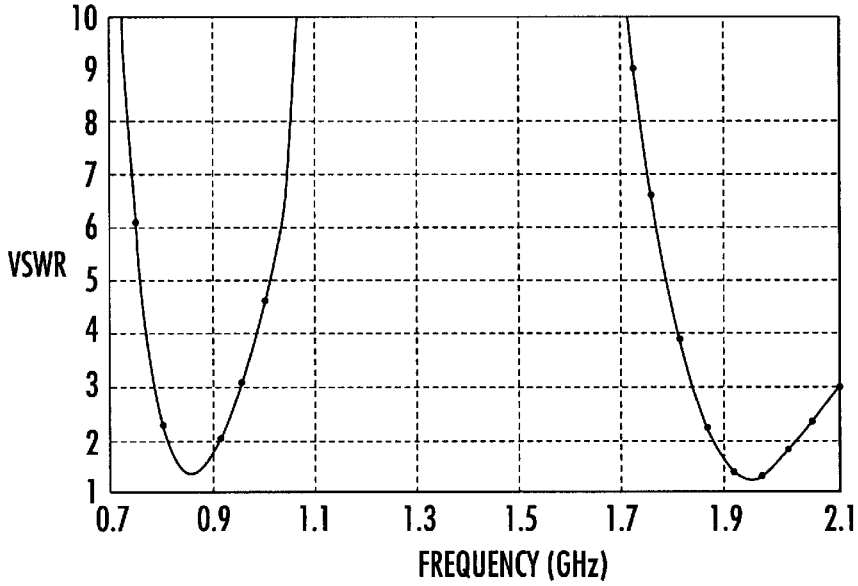
FIG. 7 is a graph of the VSWR performance of the antenna of FIGS. 4A–4D and FIGS. 5–6.

Referring now to FIG. 7, an exemplary graph of the VSWR performance of the antenna of FIGS. 4A–4D and FIGS. 5–6 is illustrated. The graph of FIG. 7 illustrates the dual-band performance of antennas according to the present invention. The antenna represented by the graph of FIG. 7 resonates around 1900 MHz and around 850 MHz. However, it is understood that the bands within which antennas according to the present invention may resonate may be adjusted by changing the shape, length, width, spacing and configuration of the various planar conductive elements (41, 42, 43, 141, 142).

Antennas according to the present invention may also be used with wireless communications devices which only transmit or receive radio frequency signals.

Such devices which only receive signals may include conventional AM/FM radios or any receiver utilizing an antenna. Devices which only transmit signals may include remote data input devices.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An inverted-F antenna that resonates within first and second frequency bands, comprising:

a first planar conductive element having opposite first and second sides, and having an elongated configuration that extends along a first direction;

a second planar conductive element electrically connected to the first conductive element, wherein the second planar conductive element is maintained in adjacent, co-planar, spaced-apart relationship with the first planar conductive element;

a third planar conductive element electrically connected to the first planar conductive element, wherein the third planar conductive element is maintained in adjacent, co-planar, spaced-apart relationship with the first and second planar conductive elements, wherein the first, second, and third planar conductive elements have respective rectangular configurations with respective first, second, and third widths, and wherein the second and third widths are greater than the first width;

a signal feed electrically connected to the first conductive element and extending outwardly from the first conductive element first side; and a ground contact electrically connected to the first conductive element adjacent the signal feed and extending outwardly from the first conductive element first side.

2. The antenna according to claim 1 wherein the second and third planar conductive elements extend along a second direction substantially parallel with the first direction.

3. The antenna according to claim 1 wherein the first planar conductive element comprises an elongated edge and wherein the second and third planar conductive elements are electrically connected to the first planar conductive element along the elongated edge.

4. The antenna according to claim 1 wherein the second planar conductive element is spaced apart from the first planar conductive element by a distance of less than or equal to about 2 millimeters (mm), wherein the third planar conductive element is spaced apart from the first planar conductive element by a distance of less than or equal to about 2 mm, and wherein the third planar conductive element is spaced apart from the second planar conductive element by a distance of less than or equal to about 2 mm.

5. The antenna according to claim 1 wherein the first, second, and third planar conductive elements are disposed on a dielectric substrate.

6. The antenna according to claim 1 wherein the first, second, and third planar conductive elements are disposed within a dielectric material.

7. An inverted-F antenna that resonates within first and second frequency bands, comprising:

a first planar conductive element having an elongated, rectangular configuration that extends along a first direction, and that comprises opposite first and second sides, and an elongated edge;

a second planar conductive element electrically connected to the elongated edge of the first planar conductive element, wherein the second planar conductive element has an elongated, rectangular configuration that extends along a second direction substantially parallel with the first direction, and wherein the second planar conductive element is maintained in adjacent, co-planar, spaced-apart relationship with the first planar conductive element;

a third planar conductive element electrically connected to the elongated edge of the first planar conductive element, wherein the third planar conductive element has an elongated, rectangular configuration that extends along the second direction, and wherein the third planar conductive element is maintained in adjacent, co-planar, spaced-apart relationship with the first and second planar conductive elements;

a signal feed electrically connected to the first conductive element and extending outwardly from the first conductive element first side;

a ground contact electrically connected to the first conductive element adjacent the signal feed and extending outwardly from the first conductive element first side; and wherein a width of the first planar conductive element is less than a width of the second planar conductive element and less than a width of the third planar conductive element.

8. The antenna according to claim 7 wherein the second planar conductive element is spaced-apart from the first planar conductive element by a distance of less than or equal to about 2 millimeters (mm), wherein the third planar conductive element is spaced-apart from the first planar conductive element by a distance of less than or equal to about 2 mm, and wherein the third planar conductive element is spaced-apart from the second planar conductive element by a distance of less than or equal to about 2 mm.

9. The antenna according to claim 7 wherein the first, second, and third planar conductive elements are disposed on a dielectric substrate.

10. The antenna according to claim 7 wherein the first, second, and third planar conductive elements are disposed within a dielectric material.

11. A wireless communicator, comprising:

a housing configured to enclose a transceiver that transmits and receives wireless communications signals;

a ground plane disposed within the housing; and a planar inverted-F antenna disposed within the housing and electrically connected with the transceiver, wherein the antenna resonates within first and second frequency bands, and wherein the antenna comprises:

an elongated first planar conductive element in adjacent, spaced-apart relationship with the ground plane, wherein the first planar conductive element extends along a first direction and comprises opposite first and second sides;

a second planar conductive element in adjacent, spaced-apart relationship with the ground plane and electrically connected to the first conductive element, wherein the second planar conductive element is maintained in adjacent, co-planar, spaced-apart relationship with the first planar conductive element;

a third planar conductive element in adjacent, spaced-apart relationship with the ground plane and electrically connected to the first planar conductive element, wherein the third planar conductive element is maintained in adjacent, co-planar, spaced-apart relationship with the first and second planar conductive elements, wherein the first, second, and third planar conductive elements have respective rectangular configurations with respective first, second, and third widths, and wherein the second and third widths are greater than the first width;

a signal feed electrically connected to the first conductive element and extending outwardly from the first conductive element first side; and a ground contact electrically connected to the first conductive element adjacent the signal feed and extending outwardly from the first conductive element first side.

12. The wireless communicator according to claim 11 wherein the second and third planar conductive elements extend along a second direction substantially parallel with the first direction.

13. The wireless communicator according to claim 11 wherein the first planar conductive element comprises an elongated edge and wherein the second and third planar conductive elements are electrically connected to the first planar conductive element along the elongated edge.

14. The wireless communicator according to claim 11 wherein the second planar conductive element is spaced apart from the first planar conductive element by a distance of less than or equal to about 2 millimeters (mm), wherein the third planar conductive element is spaced apart from the first planar conductive element by a distance of less than or equal to about 2 mm, and wherein the third planar conductive element is spaced apart from the second planar conductive element by a distance of less than or equal to about 2 mm.

15. The wireless communicator according to claim 11 wherein the first, second, and third planar conductive elements are disposed on a dielectric substrate.

16. The wireless communicator according to claim 11 wherein the first, second, and third planar conductive elements are disposed within a dielectric material.

17. A wireless communicator, comprising:

a housing configured to enclose a transceiver that transmits and receives wireless communications signals;

a ground plane disposed within the housing; and a planar inverted-F antenna disposed within the housing and electrically connected with the transceiver, wherein the antenna resonates within first and second frequency bands, and wherein the antenna comprises:

a first planar conductive element in adjacent, spaced-apart relationship with the ground plane, wherein the first planar conductive element has an elongated, rectangular configuration that extends along a first direction, and comprises opposite first and second sides, and an elongated edge;

a second planar conductive element in adjacent, spaced-apart relationship with the ground plane and electrically connected to the elongated edge of the first planar conductive element, wherein the second planar conductive element has an elongated, rectangular configuration that extends along a second direction substantially parallel with the first direction, and wherein the second planar conductive element is maintained in adjacent, co-planar, spaced-apart relationship with the first planar conductive element;

a third planar conductive element in adjacent, spaced-apart relationship with the ground plane and electrically connected to the elongated edge of the first planar conductive element, wherein the third planar conductive element has an elongated, rectangular configuration that extends along the second direction, and wherein the third planar conductive element is maintained in adjacent, co-planar, spaced-apart relationship with the first and second planar conductive elements;

a signal feed electrically connected to the first conductive element and extending outwardly from the first conductive element first side;

a ground contact electrically connected to the first conductive element adjacent the signal feed and extending outwardly from the first conductive element first side; and wherein a width of the first planar conductive element is less than a width of the second planar conductive element and less than a width of the third planar conductive element.

18. The antenna according to claim 17 wherein the second planar conductive element is spaced-apart from the first planar conductive element by a distance of less than or equal to about 2 millimeters (mm), wherein the third planar conductive element is spaced-apart from the first planar conductive element by a distance of less than or equal to about 2 mm, and wherein the third planar conductive element is spaced-apart from the second planar conductive element by a distance of less than or equal to about 2 mm.

19. The antenna according to claim 17 wherein the first, second, and third planar conductive elements are disposed on a dielectric substrate.

20. The antenna according to claim 17 wherein the first, second, and third planar conductive elements are disposed within a dielectric material.

* * * * *